United States Patent [19]

Csillag et al.

[11] 3,990,965

[45] Nov. 9, 1976

[54] FLOTATION PROCESS FOR THE ENRICHMENT OF BAUXITES

[75] Inventors: Zsolt Csillag; Lajos Orban; Karoly Solymar; Vilmos Stefaniay; Ivan Feher, all of Budapest, Hungary; Miomir Ceh, Belgrade, Yugoslavia; Ljiljana Jankovic, Belgrade, Yugoslavia; Slavoljub Bratuljevic, Belgrade, Yugoslavia; Predrag Bulatovic, Belgrade, Yugoslavia

[73] Assignees: Femipari Kutato Intezet, Budapest, Hungary; Rudarski Institut, Belgrade-Zimun, Yugoslavia

[22] Filed: Nov. 26, 1974

[21] Appl. No.: 527,295

[30] Foreign Application Priority Data

Nov. 29, 1973 Hungary ..... FE 916

[52] U.S. Cl. ..... 209/5; 209/166

[51] Int. Cl.[2] ..... B03B 1/04

[58] Field of Search ..... 209/5, 166, 9, 11; 210/54

[56] References Cited

UNITED STATES PATENTS

| | | | |
|---|---|---|---|
| 2,238,662 | 4/1941 | Shepard | 209/166 |
| 2,341,046 | 2/1944 | Kirby | 209/166 |
| 2,387,856 | 10/1945 | Pickens | 209/166 |
| 3,017,028 | 1/1962 | Schoeld | 209/167 |
| 3,194,758 | 7/1965 | Lissant | 210/54 |
| 3,425,548 | 2/1969 | Fenske | 209/166 |
| 3,430,765 | 3/1969 | Allen | 209/166 X |
| 3,509,021 | 4/1970 | Woodward | 209/5 X |
| 3,539,003 | 11/1970 | Cundy | 209/5 |
| 3,572,504 | 3/1971 | DeCuypel | 209/166 |
| 3,844,412 | 10/1974 | Dominique | 209/166 |

FOREIGN PATENTS OR APPLICATIONS

| | | | |
|---|---|---|---|
| 861,697 | 11/1940 | France | 210/54 |
| 799,873 | 8/1958 | United Kingdom | 210/54 |

*Primary Examiner*—Robert Halper
*Attorney, Agent, or Firm*—Young & Thompson

[57] ABSTRACT

An improved process for the enrichment of bauxites with unfavorable textures and low qualities via flotation and carried out after selective agglomeration. According to the process of the invention a water-soluble prepolymer of low chain length is added to the slurry as flocculating agent, thereafter the polymerization is started again by heating the slurry and/or adjusting its pH and/or adding a catalyst thus converting the polymer chain fragments adhered onto the gangue with high surface activity into a cross-linked resin, and finally the slurry is subjected to flotation in the presence of a conventional flotation aid.

2 Claims, No Drawings

FLOTATION PROCESS FOR THE ENRICHMENT OF BAUXITES

This invention relates to a process for the enrichment of bauxites having unfavourable textures and low qualities, via flotation carried out after selective agglomeration.

In connection with the enrichment of bauxites several classic flotation methods were described so far. The efficiency of these processes is, however, very low, thus they could not be put into practice. References of theoretical value were also issued about the selective flocculation of ores other than bauxite, these had, however, no practical applicability.

Promising results can be obtained with these processes only when mineral row materials with favourable textures are to be treated, that is, when the crushing to a particle size of 150 to 300 $\mu$m (that is, to the usual particle size utilized at flotation) provides a material consisting mainly of monocrystals. No enrichment can be obtained by the known processes using oleic acid, oleates, different amines and polyamines as collecting agents in the conventional flotation technique when ores or unfavourable textures are used as starting materials, although the combination of these reagents provides acceptable results in the flotation of ores artificially prepared from mixtures of pure minerals. The failure of these trials can be attributed to the fact that, in order to ensure their appropriate digestability, the bauxites with unfavourable texture, i.e. consisting of very fine unit crystals, are to be crushed to a particle size of 5 to 20 $\mu$m,. i.e. a particle size far lower than usual. It is generally known, however, that when subjecting ores containing iron oxide minerals to flotation the disturbing effect of iron oxide greatly increases with the decrease of the particle size of the substance to be floated. This phenomenon can also be observed in the conventional flotation procedures starting from ores with a particle size below 150$\mu$m. Geothite sludge has a particularly strong disturbing effect, making impossible the flotation even in an amount of 0.5%, i.e. in an amount always present in the bauxites. An additional disadvantage results from the presence of hematite, always contained in the bauxites in a substantial amount. The specific effect of hematite is less disadvantageous than that of goethite, but due to the greater amount of hematite this substance causes just the same troubles as goethite. These troubles manifest themselves in that a great amount of a tough foam is formed during flotation, which mechanically sweeps away any solid particles, independent of their surface properties, and thus completely destroys the even initially low selectivity of the known processes. In the course of further experiments it was also proven that the most potent known iron oxide suppressing reagents become almost completely ineffective when approaching the particle size of the sludge flotation, or they are to be added in an amount higher than the threshold value. In this latter case the iron oxide suppressing agents start to activate the aluminium minerals and thus increase the aluminium losses, or, respectively, they further decrease the low selectivity of the flotation.

According to a virtually obvious solution the iron oxide particles should be agglomerated selectively after crushing, thus decreasing their active surface and suppressing their deleterious effects. In practice, however, this selective agglomeration has several difficulties, since a part of the known flocculants (such as the lower polymers) are not effective enough and thus cannot decrease the specific surface in a satisfactory manner, while other flocculants (such as higher polymers) having greater surface charge and thus greater flocculant effect are not selective just as a consequence of their great surface charges. Due to these facts the selective flocculation could not reach a practical significance till now.

The invention is based on the recognition that a reagent or reagent combination, combining the advantages both of the higher and lower polymers, is prepared by suspending the polymerization after reaching an appropriate chain length, this prepolymer is mixed into the slurry to be subjected to flotation wherein the prepolymer is bound selectively to the appropriate mineral surfaces, thereafter the polymerization is started again in the slurry, whereupon the polymeric chain fragments once bound to the deleterious, that is, foam-stabilizing mineral particles, form a cross-linked structure incorporating the said mineral particles thus removing or suppressing their undesirable surface activity. Thereafter the flotation can be carried out with a good efficiency.

Accordingly, this invention relates to a process for the enrichment of bauxites with unfavourable textures and low qualities via flotation carried out after selective agglomeration, in which water-soluble, low-chain prepolymer is added to the slurry as flocculating reagent, thereafter the polymerization is started again by heating the slurry, the polymeric chain fragments once adhered to the deleterious mineral particles with high surface activity are converted into a water-insoluble cross-linked resin, and subsequently the mixture will be subjected to flotation.

Applying this process, any component of a multicomponent ore can be isolated separately, even those minerals which are partially covered by the cross-linked polymeric structure. This phenomenon can be explained by the fact that several different intermediate polymerization products are formed from the same type of the prepolymer (generally an aminoplast) even in those instances when the prepolymer contains mainly identical (i.e. functional) molecules, and these intermediate polymerization products adhere to different mineral particles with a great selectivity. Thus, for example, when phenol and formaldehyde are used as starting substances, the following components appear in the polymerization mixture in different ratios, depending on the progress of the polycondensation: phenol, saligenine, p-methylol-phenyl, 2,6-methylol-phenol, 2,4-dimethylol-phenol, 2,4,6-trimethylol-phenol and tetramethyloldiphenylmethane. On the basis of the reaction rules only determined components become conditioned during the further polymerization, thus the selective adsorption of the prepolymer components is followed by a selective conditioning as a result of which selective agglomerates are formed, differing from each other not only with respect to the mineral components but also with respect to the polymers. As a consequence of these differences the obtained particles might possess different surface properties and different dimensions even when completely covered with the polymer, and, consequently, remain separable from each other.

This invention is based on the phenomenon that the low-chain (dimeric, trimeric, etc.) water-soluble molecules of the so-called aminoplasts and phenoplasts, that is, ureaformaldehyde and phenol-formaldehyde condensation polymers, adhere selectively onto the surface of iron oxide minerals. These low-chain prepolymers undergo, however, further condensation steps upon different reactions, as a result of which they lose their water-solubility and thus become indifferent as to the further operative steps. It is also advantageous to subject the mixture to a vigorous shear-stirring (using a stirrer causing strong turbulence, such as a turbo-stirrer or "Ultra-turrax" stirrer) prior to flotation or enrichment, primarily in those instances when the enrichment is carried out in a non-stirred system, such as in pneumatic flotation cells or electric equipment. This stirring separates from each other the incidentally adhered agglomerates of different compositions, since the bond between these different agglomerates is weaker than the intraparticular bonds. A further advantage results from the fact that when applying stronger shearing force the too large agglomerates of identical composition can also be disrupted in order to ensure the optimum particle size distribution. Summing up, this stirring operation serves to increase the efficiency of the enrichment. The necessary peripheral speed of the stirring depends also to some extent on the design of the stirrer and on the nature of the raw mineral. Accordingly, it is recommended to determine separately the optimum stirring speed for the individual cases, but the optimum is between 5 and 30 m./sec. in most of the cases.

The starting substances for the resin formation may contain, besides urea and formaldehyde, also phenol, cresol, thiourea, melamine, aniline, xylenol, resourcinol, paraformaldehyde, furfurol, different amines (e.g. triethanolamine) and the like. Depending on the starting substances and the precondensation conditions, a wide variety of the reagents can be prepared. Since the exhaustive description of these reagents is almost impossible, only those are mentioned in the specification which gave the best results in our experiments. Among these reagents a composition prepared in the Hungarian Institute FEMKUT and consisting mainly of dimethylurea, as well as of the reagents sold under the tradenames EVM Arbocol H, Paraprett and Rezofin, can be mentioned. These reagents should be added in an amount of 50 to 250 g./ton for flotation, and in an amount of 250 to 500 g./ton for sedimentation.

Further members of the reagent combination include quebracho and alkylpyridinium bromides, chlorides, and, in certain cases, iodides. Of the alkyl radicals, first of all the cetyl radical can be mentioned. In the compositions described in the Examples cetylpyridinium bromide (CPB), cetylpyridinium chloride (CPCl) and cetylpyridinium iodide (CPJ) were used. In the process of the invention several other collecting reagents, such as different amines, or modifying reagents, such as different bases, hydrohalides, carboxylic acids, etc. can be used as well.

The reagents should be added in the sequence: aminoplast, quebracho, CPB or CPCl into the thick (600 to 800 g./l.) slurry under a constant stirring of medium intensity. Thereafter the slurry will be conditioned for about 0 to 30 minutes at a temperature of 80° to 100° C under mild stirring (peripheral speed: 0.1 to 0.5 m./sec.).

The further condensation of the aminoplasts and phenoplasts can be initiated by one or more of the following measures:

1. Dilution below a predetermined concentration, that is, mixing the prepolymer with the slurry. This leads, however, to a too slow reaction, thus the reaction is generally accelerated by one or more of the further methods.

2. Heating of the slurry.

3. Adjusting the pH to a proper value. An acidic medium also accelerates, or, respectively, initiates the condensation process. A strong alkaline medium, having a pH above 10, has a similar action for resorcinol or melamine resins.

The heating rate up to the conditioning temperature has an important role. This rate must not be lower than a critical value, which is, in general, 3° C/min., and, for bauxite, 7° C/min. Namely the distribution of the compounds formed in this heating period depends to a great extent on the actual temperature, and the formation of the undesired products can be avoided by passing rapidly through the temperature range in which these undesired products form, whereby a compound distribution, optimum with respect to the most selective absorption or agglomeration, can be ensured.

Quebracho (tannic acid) ensures the pH value required to accelerate the polymerization, furthermore it activates the kaolinite (silicic acid minerals), dolomites (carbonates), and, in an appropriate concentration, suppresses boehmite and hematite. This latter concentration is about 50 g./ton. for flotation and about 1000 g./ton for sedimenting, if quebracho is used together with CPB.

CPB, CPCl and CPJ are, in fact, collecting reagents, which accelerate simultaneously the polymerization. When examining their effect only with respect to the silicium-oxide yield, CPB and CPJ differ from each other in that CPJ is also effective in lower amounts. Taking into consideration that CPJ is a more expensive chemical than CPB, the use of the former chemical has no advantages from economical viewpoints. A further difference between these two chemicals arises from the fact that CPJ is less selective than CPB when bauxites of unfavourable textures are to be treated. Accordingly, preferably CPB is used in the process of the invention. Care should be taken that the collecting reagent (e.g. CPB) should not be added in excessive amounts, since in this event e.g. the $SiO_2$ and $CaMgCO_3$ yields decrease in the waste rock of bauxite, while the hematite yield increases. The optimum amount of the collecting reagents is 20 to 150 g./ton for flotation and 300 to 800 g./ton for sedimenting.

When the conditioning (polymerization) is over, the bauxites are subjected to flotation preferably in a neutral medium. Upon increasing or lowering the pH of the system by the addition e.g. of sodium hydroxide, hydrogen chloride, hydrogen bromide, hydrogen iodide, etc. the result worsens to a minor extent, the actual worsening being dependent on the nature of the bauxite. Taking into consideration that the use of an acid or alkali results in extra expenses, it can be stated that in the flotation of bauxites a non-neutral medium should only be used if a special rare mineral is also to be separated. The pH value has greater significance with respect to the separation of the other minerals, because e.g. the flotation of iron ores using CPCl can be carried out with the best results in a neutral or alkaline medium (pH 10 to 13), depending on their composition, while the dolomite impurity can be separated from limestone with the best efficiency in an acidic medium (pH 3 to 5) using CPB.

The following Examples relate to special procedures for the flotation of different bauxite types.

Although bauxites of different origin are greatly different from each other with respect to their properties, they can be classified into two main groups on the basis of their textures. This relates first of all to the boehmite-type bauxites. Bauxites wherein the iron oxides form a more firm crystal structure with boehmite (such as the Hungarian bauxites) belong to the first group, while those wherein the kaoline forms a more firm crystal structure with boehmite (such as the Yugoslavian bauxites) belong to the second group. These textural properties can be taken into account during the flotation as indicated in the Examples.

EXAMPLE 1

When a firm boehmite-hematite connection exists, that is, when the major part of the particles consists of small boehmite-hematite cryptocrystal agglomerates which practically cannot be degraded to individual crystals by crushing, preferably CPB is used as collecting agent, since this reagent collects hematite to a minor extent, and thus the aluminium losses due to the aluminium content of the formed boehmite-hematite agglomerates removed decrease. Namely, the aliminium contained in the boehmite-hematite particles collected by CPB is discarded, thus it causes losses. It is to be noted that in this case the floating product is the gangue, that is, the process is a so-called "inverse flotation". CPB collects calcite and dolomite better than boehmite, thus it can also be used with great advantages for the enrichment of bauxites containing these minerals.

As an example, we give below the flotation conditions of a bauxite sample from Halimba, Hungary, as well as the results of these experiments.

The composition of the sample is as follows:

| | |
|---|---|
| $Fe_2O_3$ | 19.90 % by weight |
| $SiO_2$ | 8.16 % by weight |
| $Al_2O_3$ | 46.74 % by weight |
| $TiO_2$ | 2.20 % by weight |
| CaO | 3.60 % by weight |
| MgO | 1.70 % by weight |
| Roasting losses | 15.56 % by weight |

The density of the slurry to be conditioned is 500 g./l. 125 g./ton of Arbocol H, 50 g./ton of quebracho and 80 g./ton of CPB are added to this slurry under constant stirring (the peripheral speed of the propeller-stirrer is 1 m./sec.). The pH of the final slurry is 5.3. After 10 minutes of stirring the stirring speed is reduced to 0.25 m./sec. and the slurry is heated to 98° C with stirring, using a heating rate of 7° C/min. When the mixture reaches this temperature the heat source is removed immediately and the slurry is stirred in a shear stirrer for 15 minutes with a peripheral speed of 20 m./sec.

The thus-obtained pretreated slurry is subjected to flotation in a neutral medium (water) at 45° C, maintaining a slurry density of 200 g./l., and an aeration rate of 4 l./min./cell volume. The basic flotation requires 10 to 12 minutes. The sample is crushed prior to the agglomeration step in a ball mill below a particle size of 20 $\mu$.

This way 50 60% by weight of the concentrate is separated. This enriched material contains 90% of the boehmite originally present, while 80% of the kaolinite (quartz), calcite and dolomite and 60% of the hematite originally present are separated as gangue.

EXAMPLE 2

In this case of firm boehmite-kaolinite connection, when the majority of the particles exists in the form of boehmite-kaolinite cryptocrystal aggregates, it is advantageous to separate only the iron oxides, since this operation increases the base number, too. The base number is defined as follows: percentage amount of aluminium oxide minus the twofold value of the percentage amount of silicium oxide. In this instance CPCl is used preferably as collecting reagent, since it is less expensive than CPB and also provides acceptable results. In this case, too, an inverse flotation is carried out. CPCl is to be added to the slurry in an amount) of 80 to 100 g./ton, otherwise the treatment conditions are the same as described in Example 1.

Using this method the RI-3 Yugoslavian bauxite sample, rich in iron, was pre-treated and subjected to flotation. Starting from a sample crushed in dry state to a particle size below 30 t0 40 $\mu$m., an iron concentrate with a $Fe_2O_3$ content above 70% was obtained in an amount of about 20%, calculated on the weight of the raw material. This concentrate contained 50%, of the $Fe_2O_3$, 5% of the $SiO_2$ and 10% of the $Al_2O_3$ originally present.

The composition of the sample is as follows:

| | |
|---|---|
| $Fe_2O_3$ | 24.67 % by weight |
| $Al_2O_3$ | 49.60 % by weight |
| $SiO_2$ | 10.40 % by weight |
| $TiO_2$ | 2.46 % by weight |
| FeO | 0.3 % by weight |
| CaO | 0.2 % by weight |
| MgO | 0.08 % by weight |
| other minerals | traces |
| roasting losses | 11.46 % by weight |

EXAMPLE 3

This example relates to the flotation of a raw material of the same type as mentioned in Example 2. Due to the favourable texture of the stirring material the iron oxides can be separated with a purity grade enabling their further utilization as iron ores, and simultaneously a part of the $SiO_2$ present can also be separated. In this event two successive flotation steps are carried out, one with CPB, and the other with CPCl. The proper sequence of the collecting reagents should be determined individually for the individual bauxite types. The treatment conditions are the same as described in Example 2, with the difference that the first flotation is carried out using 80 g./ton of CPB, thereafter the non-floating substances are flotated again under the same conditions but in the presence of 80 g./ton of CPCl. Using this method for the flotation of an RI-2 type Yugoslavian bauxite, about 50% by weight of the starting substance is separated as aliminium concentrate containing 80% of the $Al_2O_3$ originally present together with 20% of the $SiO_2$ and $Fe_2O_3$ originally present, and at the same time an iron concentrate amounting to about 10% by weight of the starting substance with an $Fe_2O_3$ content of 70% is separated. This latter value corresponds to 20% of the $Fe_2O_3$ originally present. The iron concentrate contains 5% of the $SiO_2$ and $Al_2O_3$ originally present. The starting material is crushed to a particle size of 30 to 40 $\mu$m.

The composition of the starting sample is as follows:

| | |
|---|---|
| $Fe_2O_3$ | 15.19 % by weight |
| $Al_2O_3$ | 50.81 % by weight |
| $SiO_2$ | 18.70 % by weight |
| $TiO_2$ | 1.58 % by weight |
| FeO | 0.20 % by weight |
| CaO | 0.3 % by weight |
| MgO | 0.08 % by weight |
| other minerals | traces |
| roasting losses | 12.12 % by weight |

EXAMPLE 4

One proceeds as described in Example 3 with the difference that the second flotation step, that is, the separation of hematite from boehmite, is carried out with lauryl sulfate (Ipatex paste), by the direct flotation of boehmite after activating with formic acid.

In this case preferably also about 100 g./ton of citric acid and about 100 g./ton of benzoic acid should be added to the slurry as suppressing agents.

This process is utilized preferably when a more complete removal of dolomite is required.

EXAMPLE 5

The process of Example 3 is repeated with the difference that no directly utilizable iron concentrate is produced. Therefore flotation is carried out so as to yield an iron-rich concentrate usable for pyrogeneous processes, and a good quality aluminium concentrate usable for the Bayer technology, and to remove as high amounts of $SiO_2$, CaO and MgO as possible in the gangue. The advantage of the process is that the aluminium losses are lower in comparison with those processes aiming at the separation of only a Bayer-quality concentration, moreover the total complex procedure is more economic than that using no enrichment, and a very good quality crude iron oxide is obtained as by-product. The only problem arising in this process is that the $Fe_2O_3$ content of the iron concentrate obtainable by flotation is to be increased in order to render the subsequent pyrogeneous operations more economic. This can be solved by admixing the Fe-containing concentrate with an ore of higher iron content, thus, for example, with the red mud of a good quality Bayer-ore.

A bauxite sample originating from Halimba, Hungary (the same as used in Example 1) is ground to a particle size of 20 $\mu$m. and flotated as described in Example 2. This way an iron concentration with 50% $Fe_2O_3$ content (corresponding to 70% of the $Fe_2O_3$ originally present) is obtained; this concentrate contains also 15% of $Al_2O_3$, 10% of $SiO_2$ and 70% of the calcite and dolomite originally present. The obtained aluminium concentrate contains 80% of the $Al_2O_3$, 5% of the calcite and dolomite and 15% of the $SiO_2$ and $Fe_2O_3$originally present.

The flotation of bauxites having intermediate texture types can also be carried out with different mixtures of CPCl, CPJ and CPB.

What we claim is:

1. A process for the enrichment of bauxite admixed with gangue, comprising forming from bauxite an aqueous slurry of 600 to 800 g./l. density, adding to said slurry an aminoplast or phenoplast prepolymer, then adding to said slurry quebracho, then adding to said slurry an alkylpyridinium halogenide, further polymerizing said pepolymer by heating the slurry thereby selectively to agglomerate said bauxite, and then removing gangue from the slurry by flotation.

2. A process as claimed in claim 1, in which said further polymerization is effected by heating the slurry at a rate of at least 3° C/min. to a temperature of 60° to 100° C and stirring the slurry for 5 to 20 minutes at a peripheral stirring speed of 0.1 to 0.5 m./sec.

* * * * *